United States Patent [19]

Mulakala

[11] 3,946,904

[45] Mar. 30, 1976

[54] ENCAPSULATED TUBE DISPENSING UNIT

[76] Inventor: Maleshrao Mulakala, 47 Marlbank Road, Agincourt, Ontario, Canada

[22] Filed: Aug. 19, 1974

[21] Appl. No.: 498,604

[52] U.S. Cl. ..... 222/102; 222/105

[51] Int. Cl.[2] ..... B65D 35/28

[58] Field of Search ..... 222/102, 105, 106, 101

[56] References Cited

UNITED STATES PATENTS

| | | | |
|---|---|---|---|
| 1,700,364 | 1/1929 | Bishop et al. | 222/102 |
| 1,763,273 | 1/1930 | Strauss et al. | 222/102 |
| 2,550,537 | 4/1951 | Derrick | 222/102 |
| 3,197,072 | 7/1965 | Dick | 222/102 |

FOREIGN PATENTS OR APPLICATIONS

| | | | |
|---|---|---|---|
| 600,567 | 4/1948 | United Kingdom | 222/102 |

*Primary Examiner*—Allen N. Knowles
*Attorney, Agent, or Firm*—Hill, Gross, Simpson, Van Santen, Steadman, Chiara & Simpson

[57] ABSTRACT

A dispenser for paste or viscous liquid in tubes, which may be either counter or wall mounted. A pair of cooperating rollers having having a set of central meshing teeth are adapted to receive a tube. The rollers are mounted in a supporting bracket adapted to slide within a case. The case comprises two identically configured portions which are hinged together, and are provided with locking means to contain the bracket, and tube in position therewithin. Rotation of a projecting knob causes the contents of the tube to be dispensed. The provision of projecting teeth on the cooperating rollers ensures the elimination of any possibility of slippage or jamming of the tube.

2 Claims, 4 Drawing Figures

ENCAPSULATED TUBE DISPENSING UNIT

This invention relates to a dispenser for pastes such as toothpaste and the like, or viscous liquids, and while a principal application of the dispenser according to the invention will be by householders, it will be equally useful in laboratories, hospitals, dental clinics, and the like, where it is necessary to dispense measured quantities of pastes and viscous liquids.

Many attempts have been made in the past to provide a dispenser for toothpaste and the like, whereby a controlled quantity of paste is dispensed by pushing a crank, rotating a knob, or the like. All of the prior art apparati have had disadvantages of one sort or another. For example, dispensers devised in the past are not capable of use with tubes of various sizes, including tubes having variations in wall thicknesses. Further, paste dispensers devised in the past, without exception, have the great disadvantage that they are operable only with a tube of predetermined wall thickness. If a tube of greater wall thickness is inserted into devices for dispensing paste as devised in the past, having cooperating squeezing rollers or the like, the wall thickness of such tubes will not be accepted by the dispenser. Moreover, if the wall thickness of a tube is of lesser wall thickness than the apparatus is designed to accommodate, then slippage is inevitable.

PRIOR ART

All of the prior art dispensers employing a pair of cooperating rollers make it extremely difficult to start a new tube of paste. In other words, a great deal of manual dexterity is required by the user in order to start the tube in alignment with the rollers, and in fact to force the tube to be engaged between the squeezing rotating rollers. Additionally, all of the prior art attempts to provide a dispenser for tubes of paste are designed so as to make it impossible to re-use the cap which is provided with the tube of paste when purchased. Applicant's invention overcomes both of these disadvantages.

Applicant has reviewed the prior art found in the Canadian and United States Patent Offices, and the following patents have been carefully considered, but found wanting as follows:

U.S. Pat. No. 3,197,072, July 27, 1965 — Dick

The most obvious disadvantage is that the diameter of the squeezing rollers is greater than the diameter of the pinions whereby one revolution of the pinion will advance the squeezing mechanism along the racks more slowly than the simultaneous rotation of the squeezing rollers whereby the tube is urged upwardly into the case, making the paste orifice inaccessible for use. In other words the different pitch on the roller as compared to the racks creates an engineering problem which is insurmountable. The Dick patent also has the disadvantage of most of the prior art in that the space between the squeezing rollers is fixed, thus limiting the usefulness of the device, if in fact it is operable, as discussed above, to a tube of a single wall thickness and a tube containing paste of a predetermined viscosity.

U.S. Pat. No. 2,876,934, Mar. 10, 1959 — Brim

Again, the space between the cooperating squeezing rollers is fixed limiting the usefulness of the device to a tube having a predetermined wal thickness and the contents of which have a predetermined viscosity. Thus, should a tube having a thinner wall thickness be inserted slippage is inevitable and inoperability the result. Further, if the contents of a dispensing tube are of high viscosity the small amount of mechanical advantage provided on the ratchet mechanism of the Brim patent results in a complete failure to dispense.

U.S. Pat. No. 3,198,389, Aug. 3, 1965 — Dunning

This electically powered dispensing cabinet is again handicapped by the fixed space between the squeezing rollers whereby the wall thickness of the tube and the viscosity of the contents must be within predetermined limits or slippage occurs on the one hand or jamming occurs on the other, and in either event damage to the motor is inevitable.

U.S. Pat. No. 3,263,862, Aug. 2, 1966 (corresponding to Canadian Patent No. 743,429, Sept. 27, 1966 — Tazzeo)

A single roller is mounted with a rack at one end and a longitudinal cooperating pinion, the roller acting against a flexible plate which in turn acts against a tube. While squeezing of the tube is effected only from one side, again slippage will occur in the event of a relatively thin-walled tube, and blockage will occur in the event of a thick-walled tube, or in the case of contents of high viscosity. Moreover, if the viscosity of the tube contents is high when the squeezing roller is released there is an immediate tendency for the tube contents to reverse the roller, that is, for the roller to back up requiring further unnecessary rotation when the dispenser is next used.

U.S. Pat. No. 3,586,213, June 22, 1971 — Gill

While the apparatus of the Gill patent will theoretically operate on tubes of various wall thicknesses, even tubes of relatively thin-wall construction require the operator to exert great force in rotating the operating handle, and equally great force is required in restraining the pparatus itself. The Gill device results in the tube wall being molded as it is emptied into a zig-zag transverse configuration and this effect in combination with the resistance of the viscous paste within the tube adds to the relatively great amount of brute strength required to operate. Moreover the hinged U-shaped structure of the frame is designed to spring open between uses, making it a critical factor when the tube is again to be used, inasmuch as the tube must be placed in precise alignment with the grooves and ridges on the cooperating rollers, if wastage is not to occur.

U.S. Pat. No. 3,501,054, Mar. 17, 1970 — Maurice

A pair of cooperating spring-loaded pinions together with a relatively complex mounting mechanism, combined with a lever arrangement against which the bristiles of a tooth brush are pushed in order to effect rotation of the squeezing rollers would appear to limit the effectiveness of the device to tubes having substantially liquid contents, that is, contents of extremely low viscosity. Moreover because the rollers are spring-loaded on one side only and in fixed position on the opposite side, when the viscosity of the tube contents is of any substance then the rollers will tend to separate on the spring-loaded side and remain fixed on the opposite side, with two results, namely, then only partial tube emptying will occur and eventual jamming of the tube as it is urged only on one of its sides will occur.

Canadian Patent No. 448,378, May 11, 1949 — Davis

An opposed pair of rack and pinions is designed to receive a tube with the principal disadvantage that, again, a tube of only a predetermined wall thickness and having contents of a predetermined viscosity will effectively be emptied. More importantly, initial insertion of a tube between the cooperating pinions must occur with the pinions at the rear of the case, making it extremely difficult to ensure that the tube is properly aligned with the pinions.

Canadian Patent No. 463,370, Feb. 18, 1950 — Davis

This dispenser essentially comprises a pair of cooperating rollers fixed near the mouth of a small cabinet, and the tube of toothpaste is initially engaged between the rollers, and dangles downwardly therefrom. The tube is therefore in an unstable position, during use, and again, the fixed rollers limit the usefulness of the dispenser to tubes of predetermined wall thickness and content viscosity. Moreover the rubber-coated rollers further restrict the certainty of the tube being drawn up into the cabinet. Additionally only one of the cooperating rollers is rotated, in the expectation that the tube will be pressed against the other roller to ensure the tube advancing, removing any certainty from the action of the apparatus.

Canadian Patent No. 694,584, Sept. 22, 1964 — Cieslak

A pair of cooperating rollers one of which is engaged at both ends by means of a rack and pinion arrangement are adapted to receive a tube, but it is necessary to rotate one of the rollers in a direction opposite to the direction of flow of the tube contents. Thus, the operation of the device tends to work against itself. Here again the spacing between the cooperating rollers limits the usefulness of the device to tubes of predetermined wall thickness and contents of predetermined viscosity. Equally important the roller which is manually rotated will tend to be urged out of engagement with the second and cooperating roller and engaged with a pair of racks. Thus the disadvantage of this patent are palpable.

U.S. Pat. No. 3,289,893, Dec. 6, 1966 — Vance et al.

A dispenser for tubes having a pair of cooperating rollers one of which is adapted to be manually rotated requires, however, that the nozzle of the tube which is being dispensed be pinned in place within a casing. The obvious disadvantage of this structure is that tubes having contents of high viscosity or undue wall thickness will tend to be pulled inwardly within the case against the minimum restraining action of the pins which are designed to hold it in position. In the event that the tube thickness and/or the contents are of relatively low viscosity the rollers designed to slide within the casing and simultaneously squeeze the tube will tend to slip, again eliminating operability.

It is therefore the object of this invention to eliminate all of the disadvantages of prior art structures, and to provide a dispenser for tubes which is of simple and inexpensive construction.

A further object is to provide a dispenser for paste or viscous liquid in tubes comprising in combination a pair of identically formed case sections hingedly mounted at one end, and adapted to receive a roller assembly comprising a U-shaped bracket and a pair of cooperating rollers mounted therein; means to rotate said roller assembly projecting interiorlly of said case sections; a longitudinal rack mounted at one side of each said case sections; a longitudinal track provided in each of said case sections near the longitudinal edges thereof; and locking means to maintain said case sections in closed position.

Reference will now be made to the accompanying drawings in which.

Detailed reference will now be made to the drawings, wherein like numbers will identify like parts.

Figure 1:
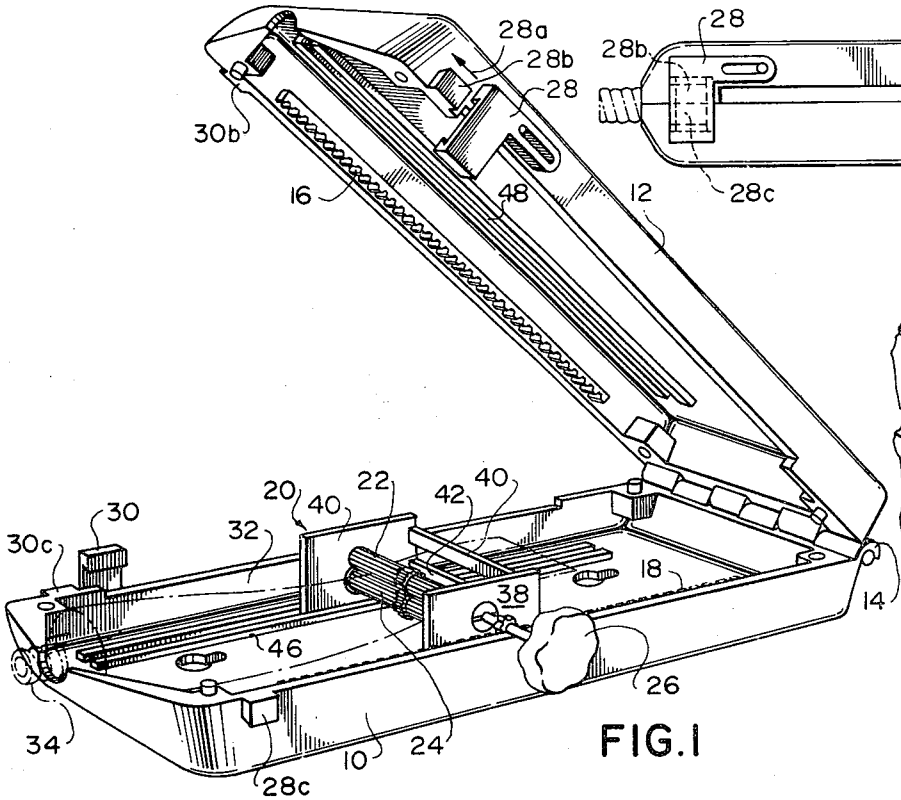
FIG. 1 is a perspective view of paste dispenser according to the invention, in open position, with a tube paste being shown in broken lines.

Referring to FIG. 1, a dispenser case comprises two identical portions 10 and 12, hinged together at one end, at 14. Case portion 12 is seen to have a longitudinal rack 16 mounted therein at one side thereof. A corresponding rack 18 provided in case section 10 is also visible. A roller assembly indicated generally at 20 is mounted in case section 10, and includes a pair of rollers 22 and 24, and a manually rotatable knob 26, projecting outside the case on one side thereof.

Figure 2:
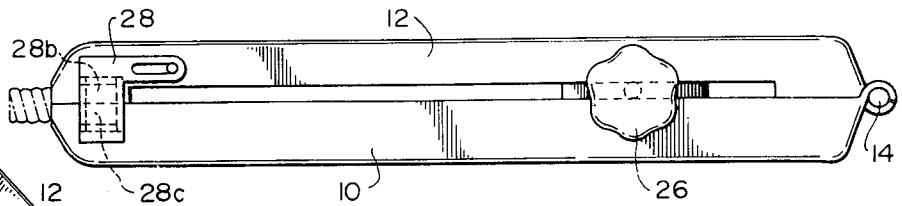
FIG. 2 is a side elevation of the dispenser of FIG. 1, in closed position.

Case section 12 is provided with a sliding locking member 28, adapted to be pushed in the direction of arrow **28*a*, to engage lug 28*b*, and lug 28*c* projecting from the side of case section 10, when case sections 10 and 12 are in closed position. A corresponding sliding locking member 30 is shown mounted on the side of the case remote from locking member 28. As seen in FIG. 2, locking member 28 is in locked position, and lugs 28*b* and 28*c* are engaged thereby in order to maintain case sections 10 and 12** in closed position.

Referring again to FIG. 1, a tube of paste 32 is seen mounted in case section 10, with its orifice 34 projecting through the end of case section 10 remote from hinge 14, and the end of tube 32 remote from orifice 34 being engaged between rollers 22 and 24.

Figure 3:
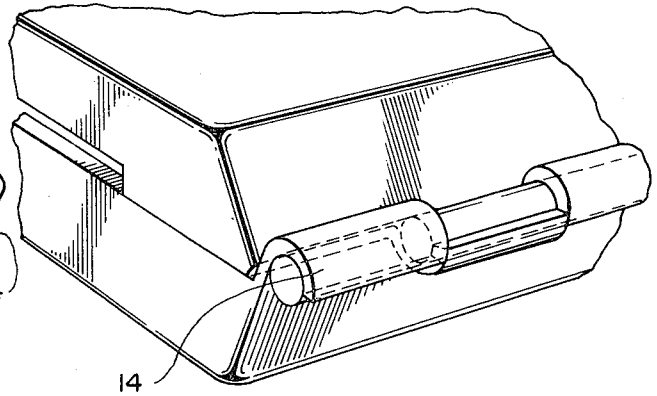
FIG. 3 is a fragmentary perspective view of the dispenser hinge.

The hinge assembly illustrated in FIG. 3 is believed to be self explanatory to one skilled in the art. it should be underlined that the portions of the hinge assembly integral with case portion 10 are identical with the corresponding hinge portions integral with case portion 12. In this as in all other regards, case portions 10 and 12 are of identical configuration, and may conveniently be constructed in the same mold.

Figure 4:
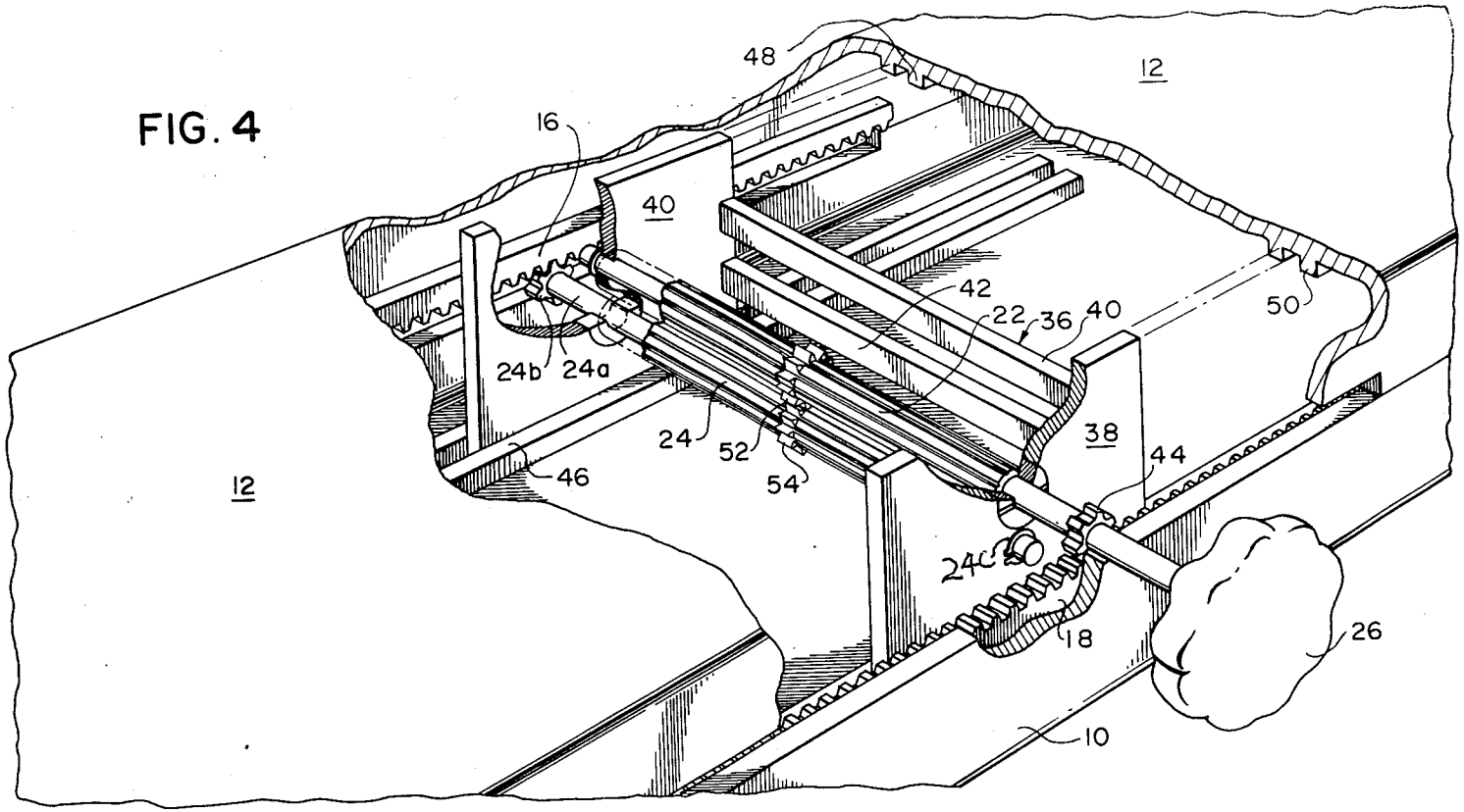
FIG. 4 is a fragmentary perspective, in enlarged scale, of the squeezing rollers, in assembled position within the dispenser.

Referring now to FIG. 4, the roller assembly comprising rollers 22 and 24 is illustrated in enlarged scale. Rollers 22 and 24 are mounted for rotation in a U-frame indicated generally at 36, and comprising two sidewalls 38 and 40 and a pair of connecting rear bars 40 and 42. Walls 38 and 40 are each provided with a pair of aligned bearing holes, adapted to receive axles projecting from rollers 22 and 24. Roller 22 is provided with an integral extension, terminating in knob 26, and having a gear 44 adapted to engagement for rack 18. Roller 24 has an integral axle **24*a* extending therefrom on the side opposite from knob 26, axle 24*a* terminating in a gear 24*b* adapted for engagement in rack 16**.

Walls 38 and 40 of U-bracket are adapted for longitudinal movement within case sections 10 and 12 in tracks provided therein. Track 46 is illustrated on the bottom interior of case section 10, and tracks 48 and 50 are illustrated on the inner top of case section 12.

Rollers 22 and 24 are provided with outwardly projecting central teeth 52 and 54, respectively, teeth 52 and 54 being closely intermeshed, while there is enough space between rollers 22 and 24 to accommodate a tube having walls of all thicknesses available on the market. In order to maintain rollers 22 and 24 so that teeth 52 and 54 remain intermeshed, rollers 24 are held on U-bracket 36 by means of spring clips, one of which is illustrated at 24*c* at one end of roller 24.

In operation, case sections 10 and 12 are opened by sliding locking member 28 in the direction opposite to that of arrow 28*a*, until lugs 28*b* and 28*c* are free, and corresponding lugs on the opposite side of the case are also freed of locking member 30. Roller assembly 20 is placed in tracks 46 and an identical track in case section 10 not illustrated, near the interior end thereof. A tube such as tube 32 is placed in case section 10 with its orifice 34 projecting from the end thereof, and the opposite end of tube 32 is engaged between rollers 22 and 24, and as seen in FIG. 1 the end of tube 32 will extend between bars 40 and 42 as the tube is emptied.

In the case of tubes manufactured of metal, it will normally be necessary to undo the sealing flange at the base thereof. This is easily accomplished using a thumbnail or the like. Happily, many manufacturers of paste are now utilizing tubes of plastics, which are seamless, and therefore it is a simple matter to engage the end thereof between rollers 22 and 24. As the tube is started between rollers 22 and 24, cooperating teeth 52 and 54 will firmly engage the longitudinal centre of tube 32, and in fact in the case of tubes of metal, slight punctures occur. It is this firm engagement by teeth 52 and 54 which ensures the elimination of any possibility of slippage of tube 32 during operation of the dispenser, and also ensures that tubes of relatively great wall thickness will nevertheless be engaged by rollers 22 and 24.

Case sections 10 and 12 are then closed, and locked by means of locking members 28 and 30 on lugs 28*b* and 28*c*, and 30*b* and 30*c*, respectively. Rotation of knob 26 will cause roller assembly 20 to advance toward tube nozzle 34, effectively squeezing the contents therefrom through orifice 34.

Referring again to FIG. 4, it will be seen that rotation of knob 26 causes gear 44 to advance along rack 18, and simultaneously to cause teeth 52 and 54 to rotate, thus causing gear 24*b* of roller 24 to advance a corresponding distance in rack 16. Thus, roller assembly 20 is urged to advance by firm engagement with racks 18 and 16, and within tracks 46, 48, 50 and a further track now illustrated provided in the base of section 10 directly beneath track 50 of case section 12.

As illustrated in the drawings, roller assembly 20 is shown with knob 26 projecting from the right side thereof, and is therefore conveniently mounted for use by a right-handed person. Inasmuch as case section 10 and 12 are of identical configuration, it will be appreciated that roller assembly 20 may be lifted from case section 10, and reversed, whereby knob 26 will project from the left-hand side thereof, a convenient position left-handed a left-handed person. It will also be appreciated that, if desired, a number of roller assemblies 20 may be provided with a single case, whereby tubes having different contents may be quickly and easily inserted in the case, for example, in a laboratory or dental application. In other words, for purposes of economy, a number of tubes may be stored within a roller assembly, and then quickly inserted or removed from a single case, as required.

As nozzle 34 of tube 32 projects through the end of case portions 10 and 12, during use, it will be evident that the original tube cap provided on purchase may be replaced on the tube after each use, for purposes of hygiene.

It will be seen that because case sections 10 and 12 are of identical configuration rollers 22 and 24 are of identical configuration, and the projecting gears 44 and 24*b* project uniformly from the roller assembly 20 that manufacture of the dispenser according to the invention is made both simpler and less expensive inasmuch as a minimum of tooling is required. In other words, roller assembly 20 comprises U-bracket 36, and rollers 22 and 24, both of which will have one axle extending therefrom, one of which will support knob 26, the other of which need merely be cut close to gear 24*b*. Case sections 20 and 12 as has already been mentioned are identical, and a single mold is therefore required.

It has been found that great variations in tube wall thicknesses have no adverse effect on the operation of the dispenser according to the invention. Moreover, it has been found that tubes containing paste of relatively great viscosity, such as is required in some dental applications and in many laboratory applications are also effectively dispensed in relatively small quantities, or as desired.

The foregoing is by way of example only and the invention should be limited only by the scope of the appended claims.

I claim:

1. A dispenser for paste or viscous liquids in tubes, comprising in combination:

a pair of identically formed generally rectangular case sections hingedly connected together at one end;

a pair of cooperating rollers mounted in a U-shaped bracket, said U-shaped bracket and rollers comprising a roller assembly being adapted for transverse reception within said case sections;

means, on one of said rollers to rotate said roller assembly, projecting exteriorly of said case sections;

a longitudinal rack mounted at one side of each of said case sections;

a longitudinal track provided in each of said case sections near the longitudinal edges thereof;

said roller assembly including a pair of gears, one gear on each side thereof, adapted for engagement in said longitudinal racks, one of said gears being directly connected to said means to rotate said roller assembly;

locking means to maintain said case sections in closed position; and said pair of rollers each having a set of teeth projecting therefrom, centrally thereon, said teeth closely intermeshing when said rollers are rotated in said bracket.

2. A dispenser according to claim 1, said roller assembly being adapted to engage one end of a tube, the other end of said tube being adapted to project through an opening in said case sections while in closed position, whereby rotation of said means to rotate said roller assembly will forceably extrude the contents of said rube through said orifice.

* * * * *